US010441055B2

(12) United States Patent
Leonard et al.

(10) Patent No.: US 10,441,055 B2
(45) Date of Patent: Oct. 15, 2019

(54) PACKAGING AND APPLICATION DEVICE

(71) Applicant: L'OREAL, Paris (FR)

(72) Inventors: Alexis Leonard, Clichy (FR); Eric Caulier, Clichy (FR)

(73) Assignee: L'OREAL, Paris (FR)

( * ) Notice: Subject to any disclaimer, the term of this patent is extended or adjusted under 35 U.S.C. 154(b) by 122 days.

(21) Appl. No.: 15/528,728

(22) PCT Filed: Nov. 20, 2015

(86) PCT No.: PCT/EP2015/077271
§ 371 (c)(1),
(2) Date: May 22, 2017

(87) PCT Pub. No.: WO2016/079322
PCT Pub. Date: May 26, 2016

(65) Prior Publication Data

US 2017/0273441 A1 Sep. 28, 2017

(30) Foreign Application Priority Data

Nov. 21, 2014 (FR) ..... 14 61297

(51) Int. Cl.
*A45D 34/04* (2006.01)
*A45D 40/26* (2006.01)

(52) U.S. Cl.
CPC ..... *A45D 40/267* (2013.01); *A45D 34/046* (2013.01)

(58) Field of Classification Search
CPC .. A45D 34/046; A45D 34/047; A45D 40/267; A45D 40/268

(Continued)

(56) References Cited

U.S. PATENT DOCUMENTS 3,280,421 A 10/1966 Davidson
5,597,254 A * 1/1997 Vasas ..... A45D 40/267 132/218

(Continued)

FOREIGN PATENT DOCUMENTS

EP 0202932 A2 11/1986
EP 1917883 A2 5/2008
WO 2005/035142 A2 † 4/2005

OTHER PUBLICATIONS

Mar. 22, 2017 Third Party Observation issued in International Patent Application No. PCT/EP2015/077271.

(Continued)

*Primary Examiner* — David J Walczak
*Assistant Examiner* — Joshua R Wiljanen
(74) *Attorney, Agent, or Firm* — Oliff PLC

(57) ABSTRACT

The present invention relates to a packaging and application device (1) comprising an applicator (20) having an applicator member (23), and a container (10) containing the product to be applied, provided with a wiping member (30) for wiping the applicator member as it is taken out of the container, the wiping member comprising a wiping lip (35) defining a wiping orifice (37) through which the applicator member passes as it is taken out of the container, the wiping lip comprising at least one extension (40) which is directed towards the bottom of the container, is connected to the wiping lip and comes into contact with the applicator member when the latter is withdrawn from the container.

15 Claims, 2 Drawing Sheets

Figure 1:
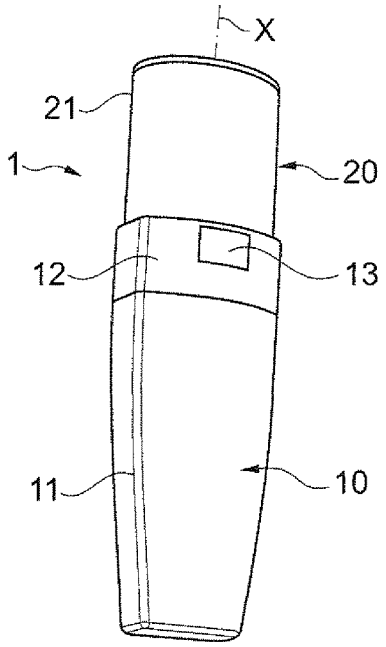

(58) Field of Classification Search
USPC ..... 401/121, 122
See application file for complete search history.

(56) References Cited

U.S. PATENT DOCUMENTS

| | | | | |
|---|---|---|---|---|
| 2005/0175394 | A1† | 8/2005 | Gueret | |
| 2009/0052969 | A1* | 2/2009 | Gueret | A45D 40/267 401/122 |
| 2013/0101337 | A1* | 4/2013 | Kulik | A45D 40/267 401/122 |

OTHER PUBLICATIONS

Jan. 29, 2016 Written Opinion issued in International Patent Application No. PCT/EP2015/077271.
Jan. 29, 2016 Search Report issued in International Patent Application No. PCT/EP2015/077271.

* cited by examiner
† cited by third party

PACKAGING AND APPLICATION DEVICE

The present invention relates to devices for packaging and applying a cosmetic product and more particularly those comprising a container containing the product to be applied and an applicator comprising an applicator member which is introduced into the container in order to be loaded with product and passes through a wiping member as it is withdrawn from the container.

The wiping member generally has a double function, namely that of wiping off the excess product present on the stem and of controlling the load of product on the applicator member. Numerous applicators have a tapered end and one of the difficulties is then that of controlling the quantity of product present at the end of the applicator member.

Various wiping members have been proposed in the publications FR 2 855 380, FR 2 865 911, FR 2 792 618, EP 1 275 322 and U.S. Pat. No. 8,221,015, with particular shapes given to the wiping lip so as to wipe the applicator member as well as possible.

U.S. Pat. No. 3,280,421 discloses a wiping orifice of circular section.

EP 0 202 932 discloses a wiping orifice defined by an edge of circular section.

There is a need to further improve wiping members in particular in order to wipe the stem in a suitable manner while allowing the applicator member to be loaded with the desired quantity of product.

The invention aims to meet this objective and achieves this aim by virtue of a packaging and application device comprising an applicator having an applicator member, and a container containing the product to be applied, provided with a wiping member for wiping the applicator member as it is taken out of the container, the wiping member comprising a wiping lip defining a wiping orifice through which the applicator member passes as it is taken out of the container.

According to the invention, the wiping lip comprises at least one extension which is directed towards the bottom of the container, is connected to the wiping lip and comes into contact with the applicator member when the latter is withdrawn from the container.

By virtue of the invention, the wiping lip can be produced such that the wiping orifice is adapted to the section of the stem of the applicator to which the applicator member is attached, in order to wipe off the product present thereon.

The extension(s) can be produced so as to wipe at least one side of the applicator member and to leave the desired quantity of product thereon.

The invention applies to any cosmetic product and in particular to a foundation, a concealer product, a complexion corrector, an eyeshadow, a lipstick, a lip gloss, a mascara or a hair dyeing product.

Preferably, the wiping lip bears at least two extensions as above, which preferably face one another so as to come into contact with two opposite sides of the applicator member. These opposite sides can correspond to the main faces of the applicator member when the latter has a flattened overall shape.

Preferably, the extension(s) is/are flexible and can deform in contact with the applicator member when the latter is withdrawn from the container. The extension(s) can also be rigid, or the wiping member can be produced with at least one extension that is more flexible and one extension that is more rigid. The more flexible extension(s) can deform in contact with the applicator member as the latter is being taken out, whereas the more rigid extension(s) do(es) not deform in a visible manner in contact with the applicator member. By acting on the rigidity of the extension(s), the applicator member can then be wiped to a greater or lesser extent and the quantity of product present thereon for application to human keratin materials can be controlled. The applicator member can have a greater quantity of product on the regions that are wiped by the flexible extensions after it has been withdrawn from the container, while those wiped by the rigid extensions bear less product.

Preferably, the extension(s) is/are in the form of (a) flexible blade(s), each having for example a curved overall shape about the axis of the wiping orifice.

Preferably, the extension(s) is/are connected to the wiping lip in a manner set back from the edge of the latter that defines the wiping orifice. The fact that the extension(s) is/are connected in a manner set back from the free edge of the wiping lip has the advantage of avoiding a situation in which their presence disrupts effective wiping of the stem by the free edge of the wiping lip.

Preferably, the extension(s) is/are connected to the wiping lip at a non-zero distance d of between 0.3 and 1 mm, for example around 0.5 mm.

The wiping orifice may have a non-circular section, in particular an oval section, for example with a shape factor L/l of between 1.5 and 4, L denoting the greatest length of the wiping orifice and l the greatest width thereof. In a variant, the wiping orifice has a circular section.

Preferably, the wiping member comprises at least two extensions, which converge towards one another away from the wiping lip, over at least a part of their height, for example over their entire height. When the extensions only converge over a part of their height, they can comprise end portions which diverge from one another in the direction of the bottom of the container. The advantage of such diverging end portions is that the risk of the applicator member being damaged by the wiping member as it is removed from the container is reduced. Each of these end portions can for example form an angle of between 20 and 40° with the axis of the wiping orifice.

The extension(s) can extend entirely beneath the wiping lip when the wiping member is viewed along its longitudinal axis, from above, that is to say from the side of the opening of the container. In a variant, the extension(s) can protrude into the wiping orifice when the wiping member is viewed from above along its longitudinal axis. By acting on the distance between the extensions, the degree of wiping and the quantity of product present at the end of the applicator member can in particular be influenced.

The wiping member may have a symmetric shape with respect to a median plane of symmetry containing its longitudinal axis. In this case, the wiping member comprises for example two identical extensions which are symmetric to one another. In a variant, the wiping member is produced with extensions which are not symmetric, for example one extension longer than the other, and/or a greater number of extensions on one side than on the other.

The applicator may comprise a stem, preferably with a non-circular section, which carries the applicator member at one end and is connected at the other end to a gripping member which may also constitute a closure member for closing the container.

The invention also relates to the wiping member as such.

Figure 2:
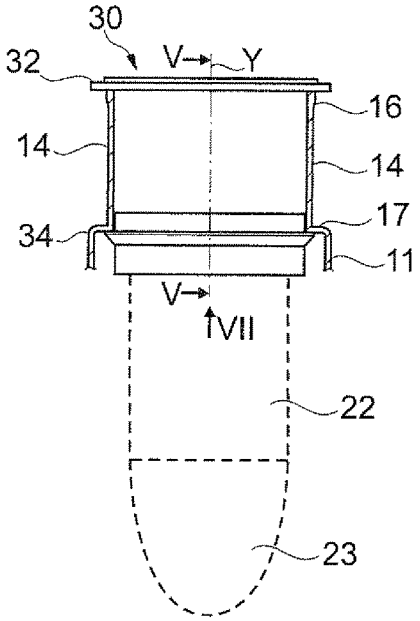
Figure 3:
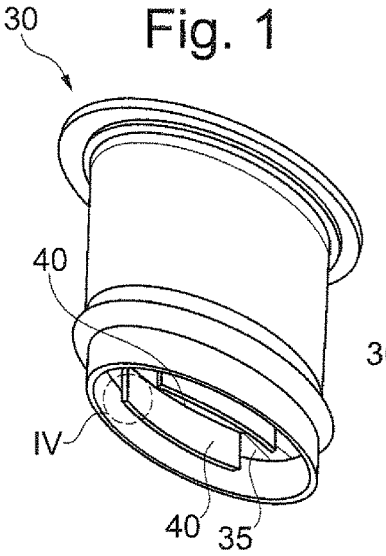
Figure 4:
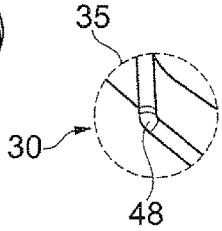
Figure 5:
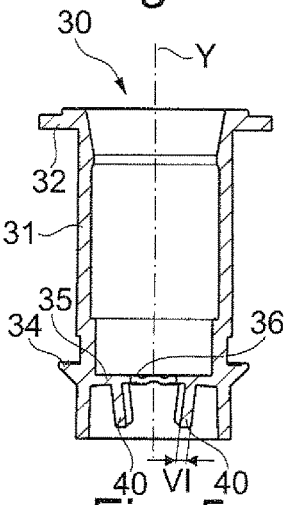
Figure 6:
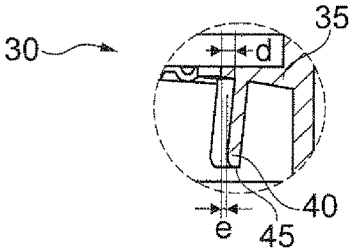
Figure 7:
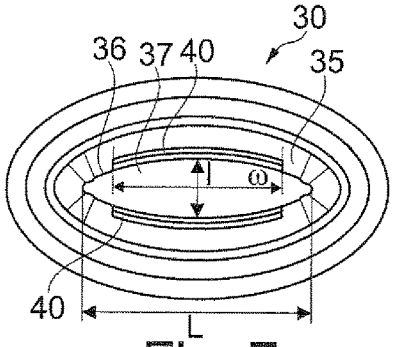
Figure 8:
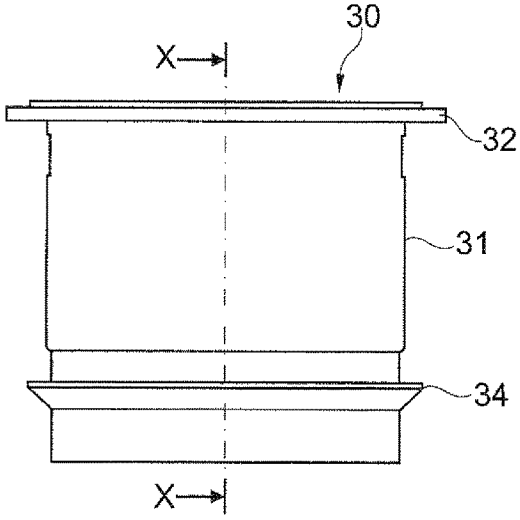
Figure 9:
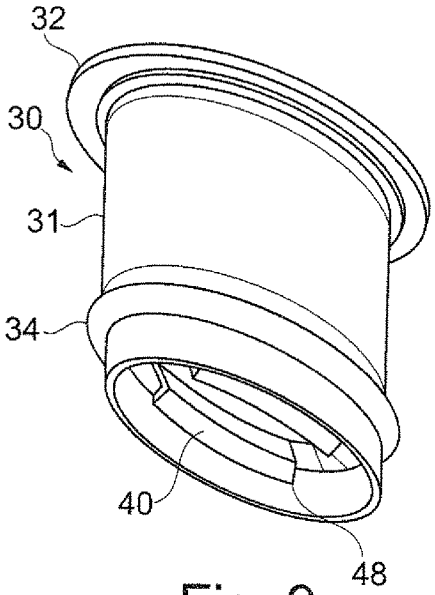
Figure 10:
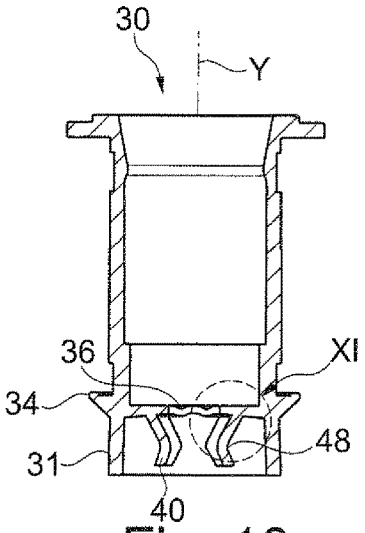
Figure 11:
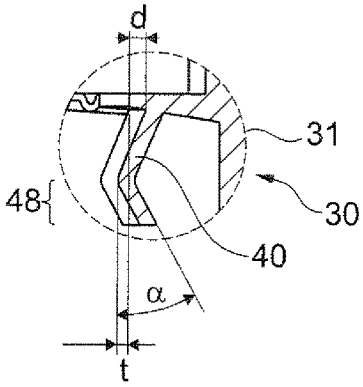
Figure 12:
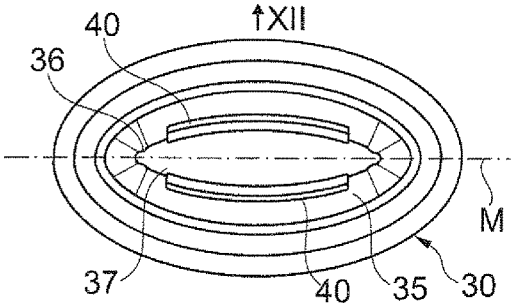
Figure 13:
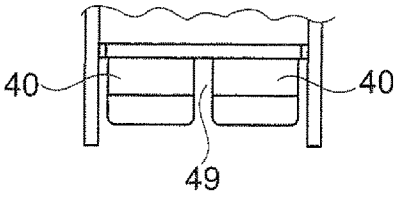

The invention may be better understood from reading the following detailed description of non-limiting implementation examples thereof, and with reference to the appended drawing, in which:

FIG. 1 shows a schematic and perspective view of an example of a packaging and application device according to the invention, FIG. 2 is a schematic view showing the wiping member of the device from FIG. 1, with a partial section of the neck of the container in which it is fixed, FIG. 3 shows a perspective view of the wiping member on its own, FIG. 4 shows the detail IV from FIG. 3, FIG. 5 is a longitudinal section through the wiping member along V-V in FIG. 2, FIG. 6 shows the detail VI from FIG. 5, FIG. 7 is a bottom view of the wiping member along VII in FIG. 2, FIG. 8 is a view similar to FIG. 7 of a variant embodiment of the wiping member, FIG. 9 shows a perspective view of the wiping member from FIG. 8 on its own, FIG. 10 is a longitudinal section along X-X in FIG. 8, FIG. 11 shows the detail XI from FIG. 10, FIG. 12 is a bottom view along XII in FIG. 8, and FIG. 13 shows a variant embodiment of the extensions on their own.

The packaging and application device 1 shown in FIG. 1 comprises a container 10 that can contain any cosmetic or dermatological product, for example a liquid foundation, and an applicator 20. The latter comprises a gripping member 21 which also serves as a closure member for closing the container 10.

The applicator 20 comprises a stem 22, illustrated very schematically by way of dotted lines in FIG. 2, which bears at its end an applicator member 23, which is constituted for example by a fine brush, a brush, a foam, or a flocked end piece, among other possibilities.

The container 10 has an elongate shape along a longitudinal axis X, which is preferably vertical when the container stands with its lower face on a horizontal flat surface.

The body 11 of the container 10 comprises a neck 14, in which a wiping member 30 according to the invention, shown in FIGS. 2 to 7, is mounted. This wiping member 30 has a longitudinal axis Y which is coincident with the axis X in the example in question.

Mounted on the body 11 is a part 12 covering the neck 14, also known as a collar, which houses a mechanism for locking the applicator 20 in place on the container, this mechanism comprising, in a manner known per se, a button 13 allowing the user to unlock the applicator.

The wiping member 30 comprises a tubular body 31 which is accommodated tightly in the neck 14 of the container. An end flange 32 is attached to the tubular body 31 at its top end and bears against the end edge 16 of the neck 14.

The wiping member 30 also has a retaining flange 34 which bears against a shoulder 17 of the body 11, at the base of the neck 14, in order to keep the wiping member 30 in the neck 14.

In FIG. 2, only the body 11 and the wiping member 30 have been shown, without the collar 12, which, after being positioned on the neck 14, can deform the flange 32 by folding it down over the neck 14.

The wiping member 30 comprises a wiping lip 35, the free edge 36 of which is continuous and defines a wiping orifice 37. In the example illustrated, the wiping orifice 37 has a non-circular, oval, shape with a shape factor L/l which is for example greater than or equal to 3, L denoting the greatest length and l the greatest width of the orifice 37, as illustrated in FIG. 7.

The shape of the orifice 37 defined by the free edge 36 is adapted to the cross section of the stem 22 so as to wipe the latter continuously along its entire perimeter.

In the example illustrated, the wiping lip 35 is situated substantially at the same height as the flange 34.

In accordance with the invention, the wiping lip 35 bears at least one extension 40 and, in the example in question, two extensions 40 that face one another.

Preferably, as illustrated, each extension 40 is attached to the lip 35 at a non-zero distance d, as illustrated in FIG. 6, from the free edge 36. This distance d is for example around 0.5 to 1 mm.

In the example in question, the extensions 40 are each in the form of a flexible blade, being concave towards one another, along the contour of the free edge 36 at the distance d, this distance d being for example constant along the entire length of the extension.

In the example illustrated in FIGS. 1 to 7, the extensions 40 converge towards one another in the direction of the bottom of the container, converging over their entire height. Each extension 40 can have a thickness which decreases in the direction of its lower end.

At its lower end, each extension 40 can have a rounding 45 that is convex towards the inside. In the example in FIGS. 1 to 7, it can be seen that it is possible for the extensions 40 not to protrude into the orifice 37 when the wiping member is viewed along its axis Y, the projection along the axis Y of each extension 40 being for example, as illustrated in FIG. 6, situated in a manner set back by a non-zero distance e from the free edge 36 of the wiping lip 35. This distance e is for example greater than or equal to 0.1 mm and for example around 0.2 mm.

Each extension 40 can have rounded corners 48, as can be seen in FIG. 4, so as to reduce the risk of the applicator member being damaged as it is removed from the container.

The extensions 40 extend for example along a distance w parallel to the major axis of the section of the wiping orifice 37, this distance w being for example greater than L/2, better still greater than ¾ of L, and for example between 10 and 18 mm, better still between 12 and 16 mm.

The variant illustrated in FIG. 12 differs from the one which has just been described by way of the shape of the extensions 40 and their position on the wiping lip 35.

In the example in FIGS. 8 and 12, the extensions 40, of which there are two, do not converge towards one another along their entire height in the direction of the bottom of the container, but have end portions 48 which diverge and form for example an angle $\alpha$ of 30° with the longitudinal axis Y, as can be seen in FIG. 11. It will also be noted in this figure that the extensions 40 can, when viewed in projection along the axis Y, project into the wiping orifice defined by the free edge 36 of the wiping lip, by a distance t which is for example greater than or equal to 0.2 mm and for example around 0.4 mm, as shown in FIG. 11.

In the examples which have just been described, the extensions 40 are continuous on each side of the orifice. In a variant, one of the extensions 40 can be replaced by two extensions that form a gap 45 between one another, so as to wipe the faces of the applicator member differently, as illustrated in FIG. 13.

The extensions 40 can be made of a rigid material, which does not deform or does not substantially deform in contact with the applicator member 23, by producing for example the wiping member by bi-injection-moulding materials with different rigidities, for example with a difference of at least 20 on one and the same Shore hardness scale. However, the wiping member is preferably produced in one piece by moulding one and the same material, preferably a thermoplastic elastomer material, for example a nitrile or SEBS.

The extensions 40 which are applied to the opposite faces of the applicator member can be given different shapes, for example different lengths.

The extensions can be given a shape that converges to a greater or lesser extent and/or a greater or lesser length, so as to bring their free ends closer together or, when the extensions are angled, as illustrated in FIGS. 8 to 11, to regulate the spacing between the closest portions of the extensions.

When the applicator 20 is used, it is withdrawn from the container along its longitudinal axis and the applicator member 23 comes into contact with the extensions 40. The latter deform in contact with the applicator member 23 and, depending on the way in which they are produced, act on the quantity of product present on the applicator member following removal of the applicator. The wiping lip 35 for its part wipes the stem 22.

The expression "comprising a" should be understood as being synonymous with "comprising at least one".

The invention claimed is:

1. Packaging and application device comprising an applicator having an applicator member, and a container containing the product to be applied, provided with a wiping member for wiping the applicator member as it is taken out of the container, the wiping member comprising a wiping lip defining a wiping orifice of non-circular section through which the applicator member passes as it is taken out of the container, the wiping lip comprising at least one extension which is directed towards the bottom of the container, is connected to the wiping lip and comes into contact with the applicator member when the latter is withdrawn from the container, wherein:

the extension(s) is/are connected to the wiping lip in a manner set back from the edge of the latter that defines the wiping orifice, and the wiping member has a symmetric shape with respect to a median plane of symmetry containing its longitudinal axis.

2. Packaging and application device according to claim 1, wherein the wiping lip bears at least two extensions.

3. Packaging and application device according to claim 1, wherein the extension(s) is/are flexible and can deform in contact with the applicator member when the latter is withdrawn from the container.

4. Packaging and application device according to claim 3, wherein the extension(s) is/are in the form of (a) flexible blade(s).

5. Packaging and application device according to claim 1, wherein the extension(s) is/are connected to the wiping lip at a non-zero distance d of between 0.3 and 1 mm.

6. Packaging and application device according to claim 1, wherein the wiping orifice has an oval section, with a shape factor L/l of between 1.5 and 4, L denoting the greatest length of the wiping orifice and l the greatest width thereof.

7. Packaging and application device according to claim 1, wherein the wiping member comprises at least two extensions, which converge towards one another away from the wiping lip, over at least a part of their height.

8. Device according to claim 7, wherein the extensions converge over their entire height.

9. Packaging and application device according to claim 7, wherein the extensions only converge over a part of their height and comprise end portions which diverge from one another in the direction of the bottom of the container.

10. Packaging and application device according to claim 9, wherein each of the end portions forms an angle of between 20 and 40° with the axis of the wiping orifice.

11. Packaging and application device according to claim 1, wherein the extension(s) extend(s) entirely beneath the wiping lip when the wiping member is viewed along its longitudinal axis, from above, from the side of the opening of the container.

12. Packaging and application device according to claim 1, wherein the extension(s) protrude(s) into the wiping orifice when the latter is viewed from above along its longitudinal axis.

13. Packaging and application device according to claim 1, wherein the applicator comprises a stem, with a non-circular section, which carries the applicator member at one end and is connected at the other end to a gripping member which constitutes a closure member for closing the container.

14. Packaging and application device comprising an applicator having an applicator member, and a container containing the product to be applied, provided with a wiping member for wiping the applicator member as it is taken out of the container, the wiping member comprising a wiping lip defining a wiping orifice of non-circular section through which the applicator member passes as it is taken out of the container, the wiping lip comprising at least two extensions, each being directed towards the bottom of the container, being connected to the wiping lip and coming into contact with the applicator member when the latter is withdrawn from the container, wherein:

the extension(s) is/are connected to the wiping lip in a manner set back from the edge of the latter that defines the wiping orifice, and the extensions converge towards one another away from the wiping lip, over their entire height.

15. Packaging and application device comprising an applicator having an applicator member, and a container containing the product to be applied, provided with a wiping member for wiping the applicator member as it is taken out of the container, the wiping member comprising a wiping lip defining a wiping orifice of non-circular section through which the applicator member passes as it is taken out of the container, the wiping lip comprising at least two extensions, each being directed towards the bottom of the container, being connected to the wiping lip and coming into contact with the applicator member when the latter is withdrawn from the container, wherein:

the extension(s) is/are connected to the wiping lip in a manner set back from the edge of the latter that defines the wiping orifice, and the extensions only converge over a part of their height and comprising end portions which diverge from one another in the direction of the bottom of the container.

* * * * *